US010234179B2

(12) United States Patent
Sedlak

(10) Patent No.: US 10,234,179 B2
(45) Date of Patent: Mar. 19, 2019

(54) THERMODYNAMIC DEVICE AND METHOD OF PRODUCING A THERMODYNAMIC DEVICE

(71) Applicant: Efficient Energy GmbH, Feldkirchen (DE)

(72) Inventor: Holger Sedlak, Sauerlach (DE)

(73) Assignee: Efficient Energy GmbH, Feldkirchen, DE (US)

( * ) Notice: Subject to any disclaimer, the term of this patent is extended or adjusted under 35 U.S.C. 154(b) by 179 days.

(21) Appl. No.: 15/043,118

(22) Filed: Feb. 12, 2016

(65) Prior Publication Data

US 2016/0161161 A1 Jun. 9, 2016

Related U.S. Application Data

(63) Continuation of application No. PCT/EP2014/067627, filed on Aug. 19, 2014.

(30) Foreign Application Priority Data

Aug. 20, 2013 (DE) ..... 10 2013 216 457

(51) Int. Cl.
*F25B 41/00* (2006.01)
*F25B 30/02* (2006.01)
(Continued)

(52) U.S. Cl.
CPC ..... *F25B 41/00* (2013.01); *F25B 30/00* (2013.01); *F25B 30/02* (2013.01); *F25B 39/02* (2013.01); *F25B 39/04* (2013.01)

(58) Field of Classification Search
CPC ..... F25B 30/00; F25B 30/02; F25B 41/00; F25B 41/06; F25B 41/067
See application file for complete search history.

(56) References Cited

U.S. PATENT DOCUMENTS 3,331,216 A 7/1967 Rayner
4,003,213 A 1/1977 Cox
(Continued)

FOREIGN PATENT DOCUMENTS

DE 1501174 A1 10/1969
EP 2016349 B1 5/2011
(Continued)

OTHER PUBLICATIONS

Breidenbach, Karl, "Der Kaelteanlagenbaur", vol. 2: Grundlagen der Kaelteanwendung. 5, Berlin [u.a]: VDE-Verlag, 2010, pp. 208-214.

*Primary Examiner* — Christopher R Zerphey
(74) *Attorney, Agent, or Firm* — Michael A. Glenn; Perkins Coie LLP

(57) ABSTRACT

A thermodynamic device includes a first liquid container configured to maintain a first pressure during operation, the first liquid container being partially filled with a working fluid during operation, a second liquid container configured to maintain a second pressure during operation, the second pressure being higher than the first pressure, the second liquid container being partially filled with the working fluid during operation; and a compensation pipe permeable to the working fluid and including an inlet arranged within the second liquid container so as to define, during operation, a working fluid level within the second liquid container, and including an outlet arranged within the first liquid container so that working fluid can be transported from the inlet into the outlet, the inlet being arranged to be higher up than the outlet in the installation direction.

15 Claims, 4 Drawing Sheets

(51) Int. Cl.

| | |
|---|---|
| ***F25B 30/00*** | (2006.01) |
| ***F25B 39/02*** | (2006.01) |
| ***F25B 39/04*** | (2006.01) |

(56) References Cited

U.S. PATENT DOCUMENTS

| | | | | |
|---|---|---|---|---|
| 5,351,488 | A * | 10/1994 | Sorensen | F03G 6/003 126/635 |
| 5,419,155 | A | 5/1995 | Boehde et al. | |
| 6,397,621 | B1 * | 6/2002 | Reynaud | F04D 17/122 62/238.4 |
| 7,841,201 | B2 * | 11/2010 | Sedlak | F04D 29/284 62/100 |
| 7,866,179 | B2 * | 1/2011 | Ophir | F25B 30/00 62/100 |
| 2007/0245759 | A1 | 10/2007 | Sedlak et al. | |
| 2007/0273024 | A1 * | 11/2007 | Madsen | F28D 15/0266 257/715 |
| 2011/0107787 | A1 * | 5/2011 | Sedlak | F24H 4/04 62/434 |
| 2012/0090339 | A1 * | 4/2012 | Ohlsson | F04F 1/18 62/119 |
| 2013/0160979 | A1 * | 6/2013 | Piesker | F25B 43/006 165/157 |
| 2016/0109139 | A1 | 4/2016 | Sedalk et al. | |

FOREIGN PATENT DOCUMENTS

| | | | |
|---|---|---|---|
| JP | 1192083527 | A | 4/1992 |
| JP | 2001165514 | A | 6/2001 |
| JP | 2006097989 | A | 4/2006 |
| JP | 2009532655 | A | 9/2009 |
| JP | 2011517760 | A | 6/2011 |
| JP | 2011205941 | A | 10/2011 |
| WO | 2007118482 | | 10/2007 |

* cited by examiner heat pump operation: $\Delta T = T_2 - T_1 \uparrow$

→ $\Delta p = p_2 - p_1 \uparrow$

→ C rotates faster

→ $V_{steam} \uparrow$

→ more heating/cooling power

THERMODYNAMIC DEVICE AND METHOD OF PRODUCING A THERMODYNAMIC DEVICE

CROSS-REFERENCE TO RELATED APPLICATIONS

This application is a continuation of copending International Application No. PCT/EP2014/067627, filed Aug. 19, 2014, which is incorporated herein by reference in its entirety, and additionally claims priority from German Application No. 102013216457.2, filed Aug. 20, 2013, which is also incorporated herein by reference in its entirety.

BACKGROUND OF THE INVENTION

The present invention relates to thermodynamic devices and, in particular, to thermodynamic devices having several liquid containers operating at different pressures, as is the case with heat pumps, for example.

European patent EP 2 016 349 B1 discloses a heat pump comprising a water evaporator, a compressor, and a liquefier. During heat pump operation, the pressure within the evaporator is set such that working fluid that is to be evaporated, such as water, for example, will evaporate at the temperature necessitated, which may be +10° C., for example. The compressor, which is configured as a continuous-flow machine having a radial impeller, compresses the steam and transports the compressed steam into a liquefier. Due to the steam compression, the temperature of the steam is increased from the temperature within the evaporator to a higher temperature, such as 40 or 50° C., for example. The heated steam will condense within the liquefier and thus heat the working fluid within the liquefier. When the heat pump is heating, the heat introduced into the liquefier by the compressed steam may be used for heating buildings. However, when the heat pump is cooling, the heat introduced into the liquefier will be discharged as waste heat, whereas the working fluid cooled by the evaporation within the evaporator will be used for cooling purposes.

On account of the heat pump operation, material is continuously transported forward from the evaporator into the liquefier. To ensure that the liquefier does not overflow, a drain is provided through which liquefied water is passed back toward the evaporator via a pump or a valve for pressure control.

As a pump or valve for pressure control, typical heat pumps comprise adjustable throttles so as to achieve conversion of high pressure within the liquefier to low pressure within the evaporator. The amount of working fluid that is transported back through the drain varies considerably since the working fluid that is transported forward also varies considerably due to the evaporation/compression/liquefying process. This is due to the fact that the heat pump varies as the power increases, or as the temperature spread, i.e. the temperature difference between the high temperature present within the liquefier and the low temperature present within the evaporator, increases. If a heat pump has to provide a large amount of power n order to achieve heating or cooling, more working fluid will be transported than if a heat pump has to provide little power in order to achieve heating or cooling. Therefore, the throttle is typically adjustable so as to be able to accommodate the wide range of different flows in the drain.

What is disadvantageous about this concept is the fact that the throttle, which even has to be adjustable, entails additional cost and additional losses in the heat pump process. In particular due to the spontaneous evaporation of the warm working fluid which typically takes place within such throttles, said warm working fluid passing into the low-pressure area, energy losses are generated and, additionally, noises are produced which contribute to the overall noise level of the heat pump. In particular when a heat pump is intended for mass utilization, which is the case with typical heat pumps, the cost for said additional component and the necessitated control also play a part that is not to be underestimated; additionally, the susceptibility to failure is also to be mentioned.

SUMMARY

According to an embodiment, a thermodynamic device may have: a first liquid container configured to maintain a first pressure during operation, the first liquid container being partially filled with a working fluid during operation, a second liquid container configured to maintain a second pressure during operation, the second pressure being higher than the first pressure, the second liquid container being partially filled with the working fluid during operation; and a compensation pipe permeable to the working fluid and including an inlet arranged within the second liquid container so as to define, during operation, a working fluid level within the second liquid container, and including an outlet arranged within the first liquid container so that working fluid can be transported from the inlet into the outlet, the inlet being arranged to be higher up than the outlet in the installation direction, the compensation pipe including a curved portion, the lowest area of which is arranged below the outlet during operation, and the thermodynamic device being configured to transport working fluid from the first liquid container forward to the second liquid container during operation and to transport working fluid back from the second liquid container to the first liquid container through the compensation pipe.

According to another embodiment, a method of producing a thermodynamic device may have the steps of: connecting a first liquid container configured to maintain a first pressure during operation, the first liquid container being partially filled with a working fluid during operation, to a second liquid container configured to maintain a second pressure during operation, the second pressure being higher than the first pressure, the second liquid container being partially filled with the working fluid during operation, by means of a compensation pipe permeable to the working fluid and including an inlet arranged within the second liquid container so as to define, during operation, a working fluid level within the second liquid container, and including an outlet arranged within the first liquid container so that working fluid can be transported from the inlet into the outlet, the inlet being arranged to be higher up than the outlet in the installation direction, the compensation pipe including a curved portion, the lowest area of which is arranged below the outlet during operation, and the thermodynamic device being configured to transport working fluid from the first liquid container forward to the second liquid container during operation and to transport working fluid back from the second liquid container to the first liquid container through the compensation pipe.

The present invention is based on the finding that, instead of an adjustable throttle, a simple compensation pipe suffices in order to effect the return transport of working fluid from a second liquid container, which may be the liquefier, for example, in the case of a heat pump, to a first liquid container, which may be the evaporator in the case of a heat pump. The compensation pipe includes an inlet arranged within the second liquid container, such as within the liquefier, for example, so as to define, during operation, a working fluid level within the second liquid container. The outlet of the compensation pipe, in turn, is arranged within the first liquid container, so that working fluid can be transported from the inlet to the outlet through the compensation pipe. In addition, the inlet is arranged, in the installation direction, to be higher up than the outlet. Moreover, the compensation pipe includes a curved portion, the lowest area of which is arranged below the outlet during operation. As a result, a thermodynamic device exists wherein, during operation, working fluid is transported forward from the first liquid container to the second liquid container, and wherein working fluid is transported back from the second liquid container to the first liquid container through the compensation pipe so as to prevent the second liquid container from overflowing or to avoid a lack of working fluid within the first liquid container.

Due to the specific arrangement of the inlet and the outlet, the compensation pipe acts as a gravitational throttle, which additionally is self-regulating. At the same time, the gravitational throttle defines, on the basis of the positioning of the inlet within the second liquid container, the liquid level within the second liquid container, which has a higher pressure than the first liquid container. As soon as additional working fluid is present within the high-pressure liquid container, said working fluid is returned to the first liquid container. Depending on the specified maximum pressure difference of the thermodynamic device between the second liquid container and the first liquid container, a maximum height of the curved portion of the compensation pipe is configured so that the liquid level near the inlet does not reach the lowest area, i.e. so that working fluid will still be present within the curved portion in the event of the largest pressure difference of the thermodynamic device so as to maintain a pressure barrier between the high pressure and the low pressure.

In a further embodiment of the present invention, wherein the working fluid within the second liquid container is warmer than that within the first liquid container, the height of the curved portion may be clearly reduced. This is due to the fact that where, in the compensation pipe, the warm working fluid enters the first liquid container, i.e. close to the outlet outside the compensation pipe or close to the outlet situated already within the compensation pipe, an additional steam barrier is formed. This is due to the fact that the warm working fluid begins to evaporate, i.e. shows a tendency to boil and/or to form bubbles, when, close to the outlet, it meets with the cold working fluid within the first liquid container. Thus, a "steam barrier" and, thus, an additional pressure drop, results within the compensation pipe. This additional pressure drop enables clearly reducing the height of the curved portion, i.e. the height of the typically U-shaped compensation pipe.

When the specified pressure difference that the thermodynamic device has to process as a maximum is 200 mbar, for example, which will be the case, in particular, when simple water is used as the working fluid, a necessitated height of the curved portion would be 2 m at the most. This means that the heat pump, when it is to be set for heating or cooling, necessitates an additional space of 2 m for installation below the liquefier so as to form the inventive gravitational throttle.

Said additional height leads to an increase in the size of the overall heat pump assembly. Due to the additional pressure difference, which will arise when the temperature of the working fluid within the first liquid container is lower than the temperature within the second liquid container, i.e. due to the additional pressure drop due to the steam barrier, said height of, e.g., 2 m may be clearly reduced, namely to as low as 5 cm or even 2 cm, while nevertheless providing a reliable thermodynamic device which comprises a gravitational throttle providing reliable separation of the pressure within the second liquid container from the pressure within the first liquid container without a pressure compensation taking place between the liquid containers via the compensation pipes.

The present invention is advantageous in that no controllable valve—which would entail all of the problems of additional losses, susceptibility to failure, and additional cost—is necessitated. Instead, a simple compensation pipe is necessitated, which may be configured, e.g., as a hose made of plastic or of metal as a very simple conduit, the diameter of which may be smaller than 10 cm. On the other hand, a minimum diameter of at least 1 cm or a minimum cross-sectional area of 0.8 $cm^2$ is advantageous.

In particular when a steam barrier additionally supports the gravitational throttle, the thermodynamic device is further characterized by a low installation height since the space "below", where the gravitational throttle is to be mounted, is clearly reduced on account of the additional steam barrier.

Additional advantages of the thermodynamic device comprising a simple compensation pipe consist in the freedom from maintenance of the compensation pipe, in the automatic adjustment of the liquid level within the second liquid container, which is determined by the inlet of the compensation pipe without necessitating any further provisions such as floaters, etc., and in the flexible mountability of the outlet within the first liquid container, where constructive measures allow this, as long as the outlet is located below the operating liquid level that is present within the first liquid container. The inlet, too, may be mounted as desired as long as it defines the liquid level, e.g. through the bottom of the second liquid container as a protruding pipe or laterally at the second liquid container at that point where the defined liquid level is supposed to be located.

The inventive thermodynamic device comprising a gravitational throttle may thus be employed wherever forward transport of working fluid is effected from the first liquid container to the second liquid container and has to be compensated for by the compensation pipe. In particular with thermodynamic devices which are configured as heat pumps and wherein the forward transport means is configured to comprise a compressor with corresponding steam intake and steam discharge, the compensation pipe is particularly suitable—due to its flexible mountability and the functionality determined by mechanical features—for a low-maintenance and particularly efficient heat pump which does not entail any losses that might be caused by a controllable throttle or the like.

A further essential advantage of the present invention consists in that the pressure difference is not wasted, as is the case in conventional technology, in an adjustable throttle due to the spontaneous evaporation taking place there. Instead, in the present invention, the pressure difference is directly introduced into the first liquid container, which is, e.g., an evaporator of a heat pump. The tendency, which is found there, toward evaporation with nucleate boiling, which forms the additional pressure barrier by which the installation height, i.e. the height of the curved portion of the compensation pipe, may be clearly reduced, further results in more efficient evaporation within the evaporator so as to reinforce the normal, or "regular", evaporation process. Thus, not only are the losses of known thermodynamic devices completely eliminated, said losses being accepted with an adjustable throttle, but also the return transport is additionally used in a positive manner for increasing the evaporation efficiency since working fluid steam generated in the vicinity of the outlet contributes to the heat pump effect just as much as does working fluid steam generated within the evaporator by means of the "normal" evaporation process.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
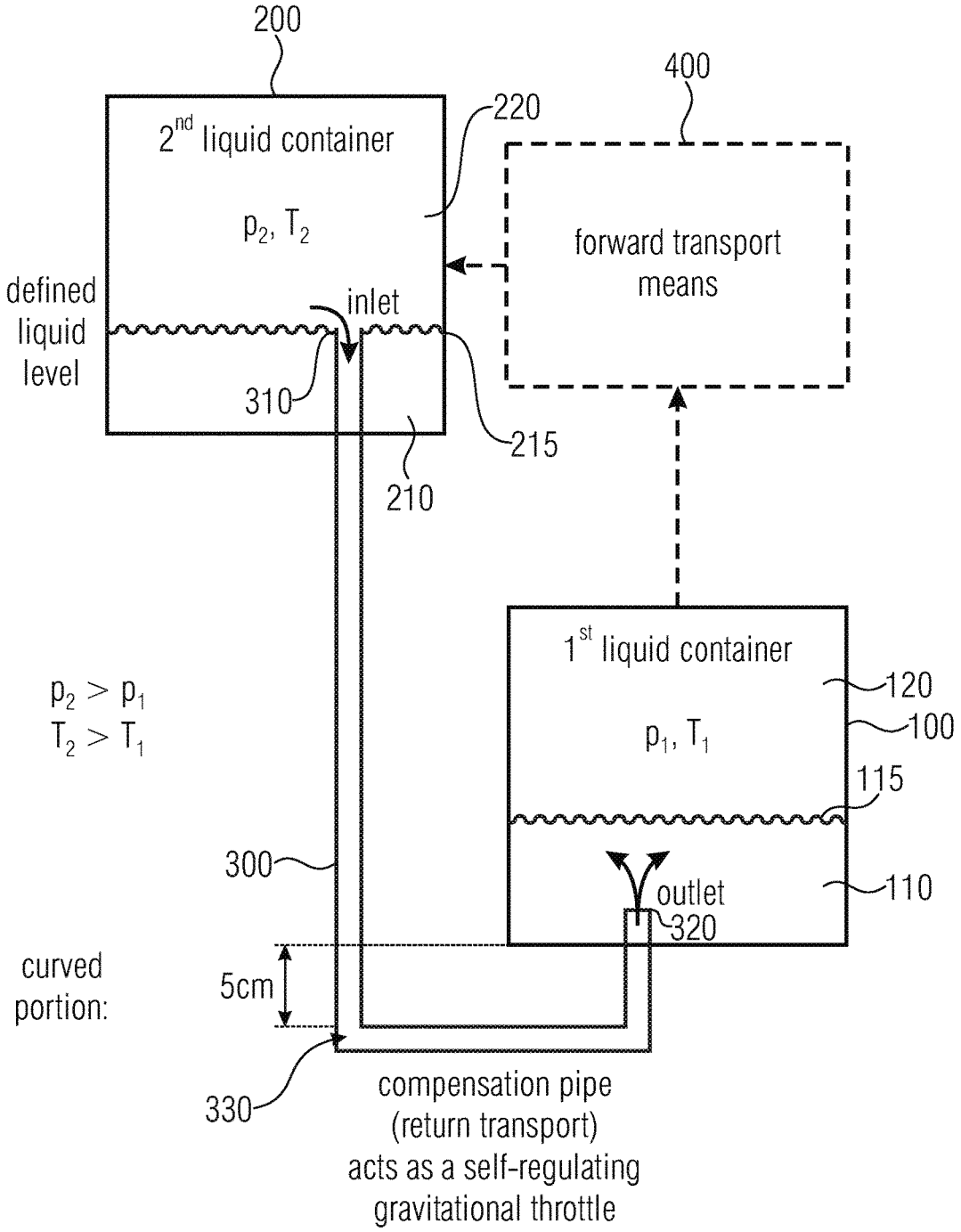
FIG. 1 shows a schematic representation of a thermodynamic device in accordance with an embodiment of the invention.

FIG. 1 shows a thermodynamic device comprising a first liquid container 100 configured to maintain a first pressure $p_1$ during operation, the first liquid container 100 being partially filled with a working fluid 110 during operation. In particular, a liquid level 115 is schematically shown in FIG. 1. Below the liquid level 115, there is the working fluid 110, and above the liquid level 115, there are air, evaporated working fluid, vacuum or the like, i.e. there is a gas compartment 120.

In addition, the thermodynamic device includes a second liquid container 200, which in turn comprises a working fluid level 215, below which the working fluid, designated by 210, is located within the second liquid container, the second liquid container having a gas compartment 220 located above it which may include air or evaporated working fluid and the pressure $p_2$ of which is higher than the first pressure $p_1$ present within the first liquid container 100. Thus, just like the first liquid container, the second liquid container is partially filled with working fluid 210 during operation.

In addition, a compensation pipe 300 permeable to the working fluid is provided which comprises an inlet 310 arranged within the second liquid container 200 so as to define, during operation, the working fluid level 215 within the second liquid container. In addition, the compensation pipe includes an outlet 320 arranged within the first liquid container 100, so that working fluid can be transported from the inlet 310 into the outlet 320. Moreover, as is shown in FIG. 1, the inlet 310 is arranged to be higher up than the outlet 320 in the installation direction of the thermodynamic device. Furthermore, the compensation pipe includes a curved portion 330, the lowest area of which is arranged, during operation, below the outlet 320 in the installation direction. Depending on the embodiment, the distance of the lowest area from the outlet, i.e. the location where the outlet enters into the first liquid container, and/or from the bottom of the first liquid container, is at least 2 and advantageously at least 5 cm. Depending on the implementation, the maximum height of the curved portion is up to 2 m, however it is not larger than is predefined by the specified maximum pressure difference between the first liquid container and the second liquid container. If the working fluid is water, for example, and if the maximum pressure difference is 200 mbar, such as in a typical water-operated heat pump, for example, as is described in EP 2 016 349 B1, the height of the curved portion, i.e. the difference between the lowest area of the curved portion and the bottom of the first liquid container, will be 2 m. The height will not be larger than 2 m, but it may be smaller than 2 m, as will be set forth below, specifically on account of the additional steam barrier, as will be described with reference to FIG. 4.

Figure 3:
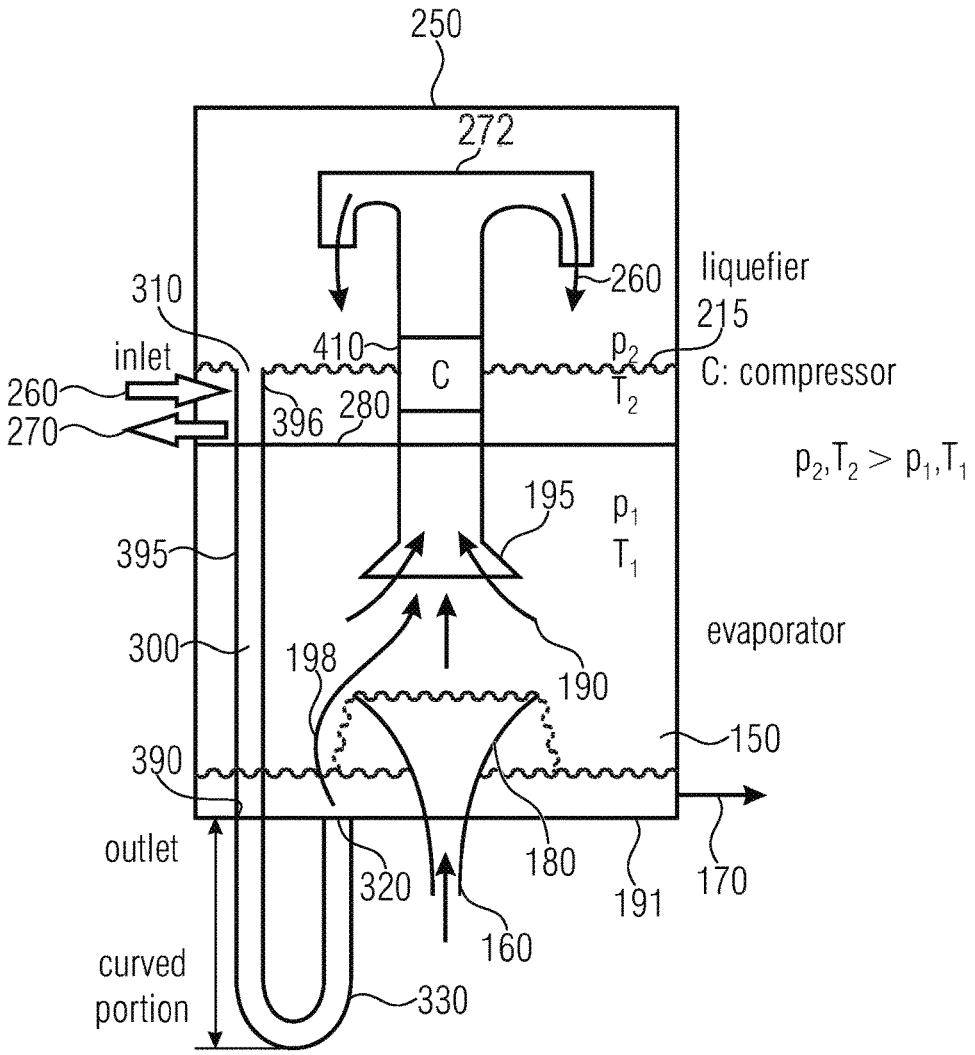
FIG. 3 shows a schematic representation of a heat pump as an embodiment of the thermodynamic device.

In an embodiment of the present invention, the thermodynamic device represented with a forward transport means 400 in FIG. 1 is configured as a heat pump. Then, the forward transport means 400 of FIG. 1 is configured as a compressor C 410 of a heat pump, as is represented in FIG. 3 or described in EP 2 016 349 B1. It shall be explicitly pointed out that in an embodiment, the inventive heat pump may be configured, except for the inventive features, precisely as it is described in EP 2 016 349 B1, said document being explicitly included into the present specification in its entirety by reference. The first liquid container 100 is configured as an evaporator 150, and the second liquid container is configured as a liquefier 250.

During operation, there are specific pressure and temperature conditions present within the heat pump. In particular, the pressure $p_1$ present within the evaporator is lower than the pressure $p_2$ present within the liquefier. In addition, the temperature T2 within the liquefier is higher than the temperature T1 within the evaporator. Working fluid to be cooled is fed into the evaporator via an evaporator intake 160, and cooled-down working fluid is carried off via an evaporator drain 170. If the heat pump is used for cooling, the cooled working fluid carried off via the drain 170 is used for cooling, such as for cooling computers or other electric or electronic devices, for example.

In addition, the liquefier, too, includes an intake 260 and a drain 270. If the heat pump is used for heating, for example, the drain 270 represents the supply into the heating system of a building, whereas the backflow element 260, wherein cooled-down working fluid is supplied into the liquefier 250 once again, represents the backflow of the heating system. In particular, the evaporator includes a widening unit 180 for efficiently evaporating working fluid. The working fluid steam 190 is then sucked in and compressed by the compressor 410 by means of a specific suction device 195 and is introduced, as the compressed working fluid steam 260, into the liquefier volume via a specific steam detour assembly 272 so as to condense with the working fluid within the liquefier, the liquid level of which is designated by 215. The liquid level 215, in turn, defines the inlet of the compensation pipe 300, of which, again, the curved portion 330 is shown in FIG. 3.

The inlet 310 is configured as a pipe protruding from a bottom 280 of the liquefier since then the height of the protrusion of the inlet from the bottom 280 defines the liquid level 215 within the liquefier, i.e. within the second liquid container of FIG. 1.

Figure 2B:
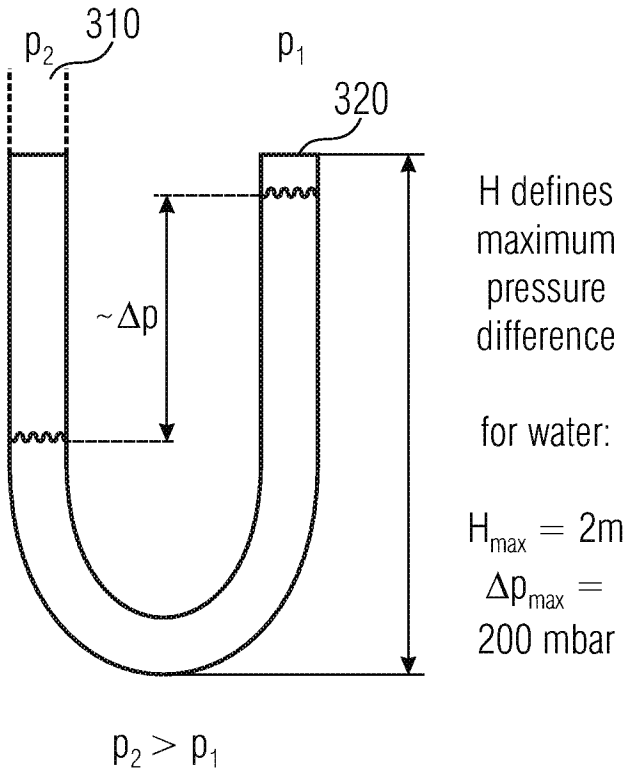
FIGS. 2*a*, 2*b* show communicating pipes with identical pressure and different pressures.
Figure 2A:
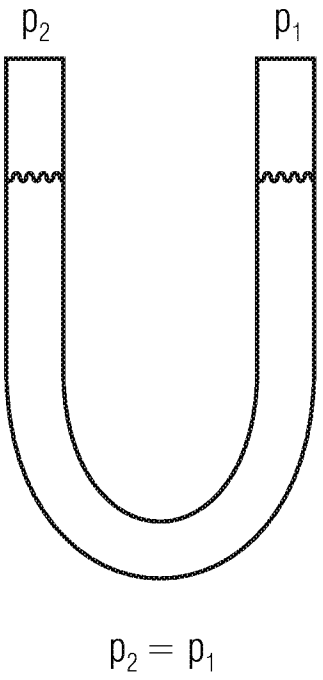

Due to the different pressure ratios that exist within both liquid containers, different heights of the liquid levels form within the compensation pipe in terms of communicating pipes, as is shown in FIG. 2*b*. By contrast, FIG. 2*a* shows the comparative case wherein the liquid levels in both branches of the communicating pipes, i.e. in both ends of a U-shaped compensation pipe, are equally high. By contrast, if on one side of the communicating pipe there is a higher pressure than on the other side, the liquid level will be lowered on that side having the higher pressure, the amount of the reduction being proportional to the pressure difference Δp. From that point of view, the maximum height H is defined such that both liquid levels in both portions of the U-shaped compensation pipe may be made to differ without the level on the left-hand side in FIG. 2*b* reaching the tip of the curved portion; in this case, there would be no more reliable pressure seal or pressure barrier between the two liquid containers having different pressures. As was already set forth, the maximum height $H_{max}$ amounts to two meters for a maximum pressure difference of 200 mbar when water is used as the working fluid. When other liquids are used as the working fluid, as are common in heat engines/refrigerating machines and are known to persons skilled in the art, the different heights and the differential pressures will vary.

Moreover, FIG. 3 shows different tendencies of heat pump operation. When the temperature difference, i.e. the difference between the temperatures present within the liquefier 250 and within the evaporator, increases, i.e. when the heat pump has to provide more power, specifically because of increased refrigerating or heating requirements, the rotational speed of the compressor C, which is configured as a turbo compressor having a radial impeller, is increased. The compressor C, or the radial impeller of the compressor, rotates faster. As a result, more steam volume is sucked in and is transported forward from the evaporator into the liquefier. In order to maintain the defined liquid level within the liquefier, it is therefore also necessitated to transport more working fluid from the liquefier back to the evaporator through the compensation pipe 330. This takes place automatically without necessitating specific control, which is specifically due to the compensation pipe, which acts as a gravitational, self-regulating throttle. However, if the temperature and/or the power requirement placed upon the heat pump decreases again, less working fluid is transported forward, and the compensation pipe will then transport less working fluid back into the evaporator. This process, too, takes place fully automatically without any further control or intervention.

FIG. 3 further shows another advantageous effect of the inventive compensation pipe, which is connected, at its discharge point, to the evaporator without any specific throttle. Due to the fact that the warm working fluid is directly fed into the cold evaporator, the warm working fluid causes a tendency toward nucleate boiling where it enters into the cold evaporator with low pressure, i.e. in the vicinity of the outlet 320. Thus, the evaporator working fluid is additionally evaporated due to the effect, which is positive in terms of evaporation, of the outlet 320, as is schematically depicted by further steam 198, which for the operation of the heat pump obviously has the same effect as the working fluid steam 190 generated by the "normal" evaporation process.

Figure 4:
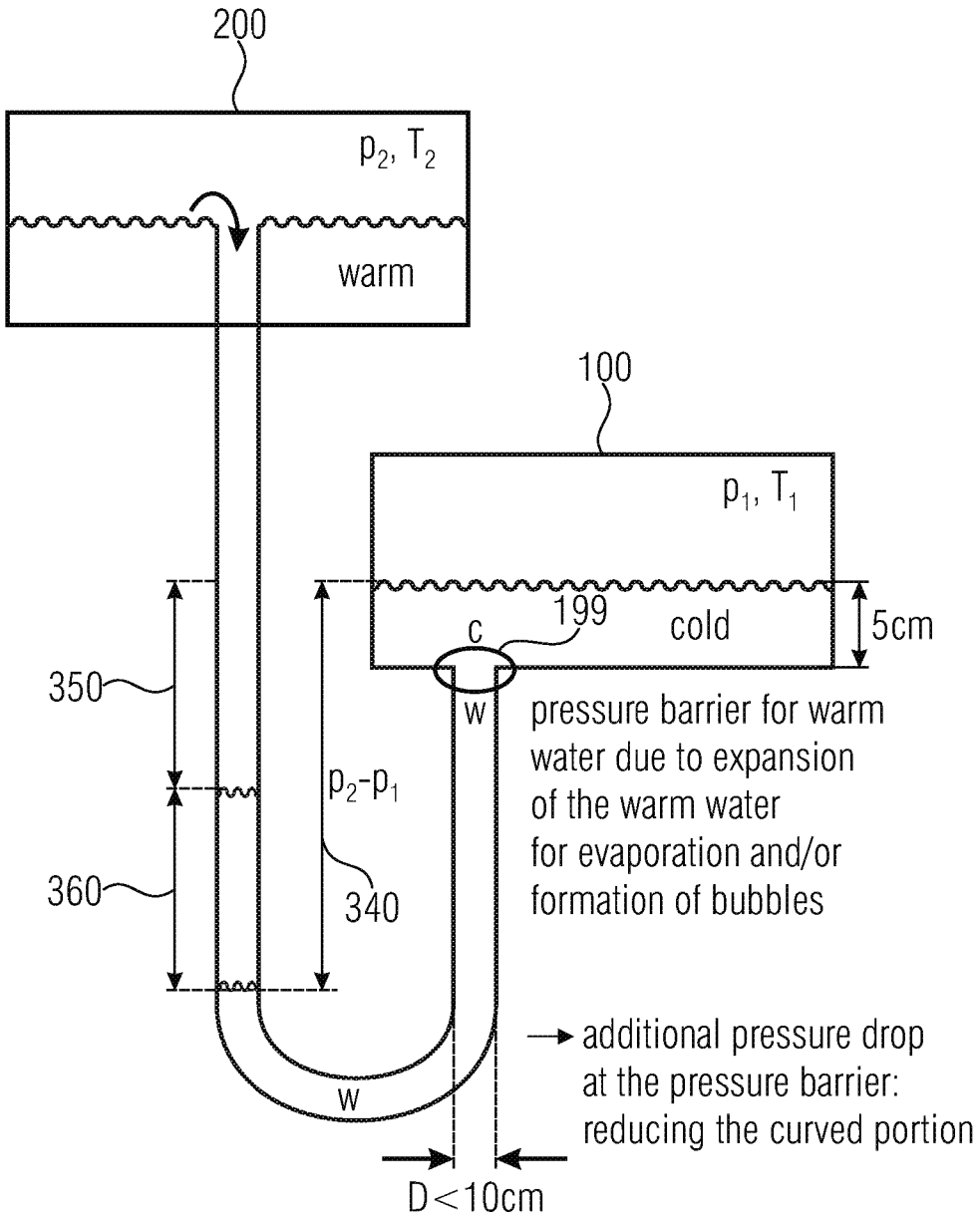
FIG. 4 shows a schematic representation of the compensation pipe with liquid containers with the additional pressure barrier close to the outlet.

With reference to FIG. 4, the pressure barrier shall be addressed in more detail below, which results for warm working fluid, such as water, for example, due to the expansion of the warm working fluid for evaporation and/or due to the tendency toward a formation of bubbles. Said pressure barrier is schematically depicted at 199 in FIG. 4.

In the area of the outlet 320, around which the pressure barrier 199 forms, there is therefore an additional pressure drop from the high-pressure area $p_2$ to the low-pressure area $p_1$. This results in that a height difference 340, which would predominate if there were no pressure barrier, decreases to a height difference 350. Thus, the pressure barrier 199 already accommodates a pressure difference which corresponds to the difference 360 of the height differences 340 and 350. This advantageous phenomenon, which becomes more and more pronounced, in particular, the larger the temperature difference between the warm temperature $T_2$ and the cold temperature $T_1$, is advantageously exploited, in accordance with the invention, for reducing the height of the curved portion 330 from the maximum height by 50% or 80%, as is depicted in FIG. 2*b*, for example, as a function of the implementation, so that, in order to ensure reliable pressure sealing between the two liquid containers, it is already sufficient to arrange the lowest area of the curved portion only slightly, e.g. 2 cm, and with a certain clearance, at least 5 cm below the outlet during operation. Thus, the installation height of the thermodynamic device, for example of a heat pump, is reduced by up to 2 m, which results in a considerable reduction in the size of the assembly and, consequently, to a considerably increased market acceptance.

The compensation pipe 300 exhibits a diameter of a maximum of 10 cm or a cross-sectional area of a maximum of 80 $cm^2$. On the other hand, the diameter of the compensation pipe is at least 1 cm, and the cross-sectional area is at least 0.8 $cm^2$.

The lowest area of the curved portion is arranged below the outlet by a maximum distance $H_{max}$, the maximum distance $H_{max}$ being determined by a maximum pressure difference between the second pressure and the first pressure. Apart from a forward transport means 400, which may be of any type desired, of FIG. 1, the compensation pipe is the only liquid communication element between the first liquid container and the second liquid container, so that the entire backflow takes place via the compensation pipe, the compensation pipe comprising no controllable throttle or no controllable valve, but possibly being configured as a simple pipe or as a simple hose even with a constant diameter across the entire length.

As is shown in FIG. 3, the outlet 320 is mounted on a container bottom 191 of the first liquid container. The curved portion 330 of the compensation pipe 300 is further configured as a U-shape, the outlet 320 being arranged at an end of the curved portion. A linear length of pipe 395 is arranged between the inlet 310 and the other end of the curved portion, which in FIG. 3 is designated by 390.

As has already been illustrated, the second liquid container 250 is further provided with a bottom 280 from which the compensation pipe protrudes by a length 396, which defines the maximum liquid level within the liquefier 250. Alternatively, however, the inlet 310 might also be arranged laterally at that height of the liquid container which defines the liquid level within the second liquid container.

In a method of producing the thermodynamic device, a compensation pipe is connected with its inlet to the first liquid container and with its outlet to the second liquid container, so that the working fluid level within the second liquid container is defined by the arrangement of the inlet within the second liquid container.

The present invention provides an efficient, low-cost and low-maintenance thermodynamic device.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Thermodynamic device comprising:

a first liquid container configured to maintain a first pressure during operation of the thermodynamic device, the first liquid container being partially filled with a working fluid in liquid form until a first liquid level during the operation of the thermodynamic device;

a second liquid container configured to maintain a second pressure during the operation of the thermodynamic device, the second pressure being higher than the first pressure, the second liquid container being partially filled with the working fluid in the liquid form until a second liquid level during the operation of the thermodynamic device, wherein, above the second liquid level, gas is present in the second liquid container; and a compensation pipe acting as a gravitational throttle and being permeable to the working fluid in the liquid form and comprising an inlet arranged within the second liquid container, wherein the inlet is arranged within the second liquid container so that the inlet defines, during the operation of the thermodynamic device, a maximum working fluid level of the working fluid in the liquid form within the second liquid container, the maximum working fluid level being greater than or equal to the second liquid level, and comprising an outlet arranged within the first liquid container so that the working fluid in the liquid form can be transported from the inlet of the compensation pipe into the outlet of the compensation pipe, wherein the inlet of the compensation pipe is arranged to be higher up than the outlet of the compensation pipe in an installation direction of the thermodynamic device for an intended use of the thermodynamic device, wherein a pipe liquid level of the working fluid in the liquid form within the compensation pipe is, during the operation of the thermodynamic device, lower than the second liquid level, and wherein, during the operation of the thermodynamic device, the gas is present within the compensation pipe between the inlet of the compensation pipe and the pipe liquid level, wherein the compensation pipe comprises a curved portion, the lowest area of the compensation pipe being arranged below the outlet of the compensation pipe during the operation of the thermodynamic device, and wherein the thermodynamic device is configured to forward transport the working fluid from the first liquid container to the second liquid container during the operation of the thermodynamic device and to backward transport the working fluid in the liquid form back from the second liquid container to the first liquid container through the compensation pipe.

2. Thermodynamic device as claimed in claim 1, which is configured as a heat pump, the first liquid container being an evaporator, the second liquid container being a liquefier arranged above the evaporator in the installation direction, a compressor being arranged so as to compress working fluid steam and feed compressed working fluid steam into the liquefier so that the compressed working fluid steam will liquefy within the liquefier.

3. Thermodynamic device as claimed in claim 1, wherein the thermodynamic device is configured such that a temperature of the working fluid within the second liquid container is higher than a first temperature of the working fluid within the first liquid container, and that the first pressure is such that the working fluid forms, during the operation of the thermodynamic device, a steam barrier at the outlet, wherein the thermodynamic device is configured such that the working fluid evaporates at the outlet during the operation of the thermodynamic device, or wherein the thermodynamic device is configured such that the working fluid exhibits formation of bubbles at the outlet during the operation of the thermodynamic device.

4. Thermodynamic device as claimed in claim 1, wherein the compensation pipe comprises a diameter of 10 cm at the most or a cross-sectional area of 80 $cm^2$ at the most.

5. Thermodynamic device as claimed in claim 1, wherein the lowest area of the curved portion is arranged below the outlet of the compensation pipe during the operation of the thermodynamic device by a distance, wherein a length of the distance is determined such that the pipe liquid level does not reach the lowest area of the curved portion in an event of a maximum pressure difference between the second pressure and the first pressure.

6. Thermodynamic device as claimed in claim 1, wherein the lowest area of the curved portion is arranged, during the operation of the thermodynamic device, at the most 2 meters below the outlet.

7. Thermodynamic device as claimed in claim 6, wherein the working fluid is water and a specified maximum pressure difference between the second pressure and the first pressure is 200 mbar.

8. Thermodynamic device as claimed in claim 1, wherein the thermodynamic device is configured as a heat pump, wherein the first liquid container is an evaporator of the heat pump, the evaporator being configured for evaporating working fluid in the liquid form to obtain working fluid steam, wherein the second liquid container is a liquefier of the heat pump, the liquefier being arranged above the evaporator in the installation direction, wherein a compressor is arranged so as to compress the working fluid steam and feed compressed working fluid steam into the liquefier so that the compressed working fluid steam will liquefy within the liquefier, wherein the feeding the compressed working fluid steam represents the forward transport of the working fluid in steam form, and wherein the compensation pipe is the only liquid communication element allowing a communication for the working fluid in the liquid form between the evaporator of the heat pump and the liquefier of the heat pump, so as to achieve the backward transport of the working fluid in the liquid form.

9. Thermodynamic device as claimed in claim 1, wherein the compensation pipe is configured as a continuous hose with a constant cross-section across the entire length.

10. Thermodynamic device as claimed in claim 1, wherein the first liquid container comprises a first liquid container bottom, the outlet being arranged on the first liquid container bottom, and a liquid level being arranged above the outlet during the operation of the thermodynamic device.

11. Thermodynamic device as claimed in claim 1, wherein the curved portion of the compensation pipe is configured to be U-shaped, the outlet being arranged at an end of the curved portion, and a linear length of pipe being arranged between the inlet and the other end of the curved portion so as to connect the other end of the curved portion to the inlet.

12. Thermodynamic device as claimed claim 1, wherein the second liquid container comprises a bottom, the compensation pipe extending through the bottom into the second liquid container and protruding from the bottom of the second liquid container into the second liquid container by a length, the length defining the working fluid level within the second liquid container.

13. Thermodynamic device as claimed in claim 1, wherein the lowest area of the curved portion is arranged at least 5 cm below the outlet during the operation of the thermodynamic device.

14. Thermodynamic device as claimed in claim 1, wherein the pipe liquid level within the compensation pipe is, during the operation of the thermodynamic device, lower than the first liquid level.

15. Method of producing a thermodynamic device, comprising:

connecting a first liquid container configured to maintain a first pressure during operation of the thermodynamic device, the first liquid container being partially filled with a working fluid in liquid form until a first liquid level during the operation of the thermodynamic device, to a second liquid container configured to maintain a second pressure during the operation of the thermodynamic device, the second pressure being higher than the first pressure, the second liquid container being partially filled with the working fluid in the liquid form until a second liquid level during the operation of the thermodynamic device, wherein, above the second liquid level, gas is present in the second liquid container, by means of a compensation pipe acting as a gravitational throttle and being permeable to the working fluid in the liquid form and comprising an inlet arranged within the second liquid container, wherein the inlet is arranged within the second liquid container so that the inlet defines, during the operation of the thermodynamic device, a maximum working fluid level of the working fluid in the liquid form within the second liquid container, the maximum working fluid level being greater than or equal to the second liquid level, and comprising an outlet arranged within the first liquid container so that working fluid in the liquid form can be transported from the inlet of the compensation pipe into the outlet of the compensation pipe, wherein the inlet of the compensation pipe is arranged to be higher up than the outlet of the compensation pipe in an installation direction of the thermodynamic device for an intended use of the thermodynamic device, wherein a pipe liquid level of the working fluid in the liquid form within the compensation pipe is, during the operation of the thermodynamic device, lower than the second liquid level, and wherein, during the operation of the thermodynamic device, the gas is present within the compensation pipe between the inlet of the compensation pipe and the pipe liquid level, wherein the compensation pipe comprises a curved portion, the lowest area of the curved portion being arranged below the outlet of the compensation pipe during the operation of the thermodynamic device, and wherein the thermodynamic device is configured to forward transport the working fluid from the first liquid container to the second liquid container during the operation of the thermodynamic device and to backward transport the working fluid in the liquid form from the second liquid container to the first liquid container through the compensation pipe.

* * * * *